US009561883B1

(12) United States Patent
Debski

(10) Patent No.: US 9,561,883 B1
(45) Date of Patent: Feb. 7, 2017

(54) METHOD OF FABRICATING A PRESCRIPTION LABEL BAG

(71) Applicant: Stefan Jerzy Debski, Winchester, VA (US)

(72) Inventor: Stefan Jerzy Debski, Winchester, VA (US)

( * ) Notice: Subject to any disclaimer, the term of this patent is extended or adjusted under 35 U.S.C. 154(b) by 503 days.

(21) Appl. No.: 14/095,243

(22) Filed: Dec. 3, 2013

(51) Int. Cl.
*B65D 30/20* (2006.01)

(52) U.S. Cl.
CPC ..... *B65D 31/10* (2013.01)

(58) Field of Classification Search
CPC ..... B65D 31/10; B65D 33/004
USPC ..... 383/120, 123–126, 40; 493/240, 243, 493/396, 397
See application file for complete search history.

(56) References Cited

U.S. PATENT DOCUMENTS 2,157,392 A * 5/1939 Williams ..... B65D 31/02 383/109
2,353,311 A * 7/1944 Karlson ..... B65D 31/08 383/126
2,353,605 A * 7/1944 Waters ..... B65D 31/08 383/126
2,444,762 A * 7/1948 Waters ..... B65D 31/08 383/126
2,837,267 A * 6/1958 Potdevin ..... B65D 31/10 383/123
3,023,946 A * 3/1962 Steen ..... B65D 33/02 383/126
3,231,173 A * 1/1966 Civitello ..... B65D 31/08 383/115
3,289,915 A * 12/1966 Civitello ..... B31B 37/00 383/115
4,008,850 A * 2/1977 Goodrich ..... B65D 31/10 383/109
5,163,756 A * 11/1992 Riseman ..... B32B 7/06 206/831
6,206,570 B1 * 3/2001 Cortopassi ..... B65D 33/004 383/111
6,227,707 B1 * 5/2001 Anderson ..... B65D 33/004 206/831
8,591,110 B2 * 11/2013 Smith ..... B65D 31/08 383/113
2006/0126972 A1 * 6/2006 Tighe ..... B65D 31/04 383/109

* cited by examiner

*Primary Examiner* — Jes F Pascua
(74) *Attorney, Agent, or Firm* — Neustel Law Offices; Jason L. Gilbert

(57) ABSTRACT

A method of fabricating a prescription label bag which creates a simple, effective and private labelled bag for storing various prescriptions or medicines. The method of fabricating a prescription label bag generally includes a sheet having a plurality of folding indicia preset therein for ease-of-folding into a prescription bag. Adhesive strips are located along the sheet to ease formation of the bag after completion of the necessary folds using the folding indicia. The formed prescription bag includes an upper opening through which the prescription items may be inserted into the bag and a sealed lower end. A label or printed information may be included on the outer surface of the bag to provide instructions or other relevant information regarding the prescription.

6 Claims, 10 Drawing Sheets

METHOD OF FABRICATING A PRESCRIPTION LABEL BAG

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a prescription bag and more specifically it relates to a method of fabricating a prescription label bag which creates a simple, effective and private labelled bag for storing various prescriptions or medicines.

Description of the Related Art

Any discussion of the related art throughout the specification should in no way be considered as an admission that such related art is widely known or forms part of common general knowledge in the field.

It is very common for department stores, grocery stores, and pharmacies to dispense prescription drugs to consumers in a public setting. When dispensing such drugs, the instructions are often included in a small label affixed directly to the drug container (i.e. pill bottle or casing). This small label can be hard to read. Often, a separate sheet of paper may be provided with instructions that is loosely thrown in a larger bag with the prescription drugs and thus may be lost or misplaced. Further, the prescription drugs are often just thrown in a large bag, often with other items.

Because of the inherent problems with the related art, there is a need for a new and improved method of fabricating a prescription label bag which creates a simple, effective and private labelled bag for storing various prescriptions or medicines.

BRIEF SUMMARY OF THE INVENTION

The invention generally relates to a prescription bag formation method which includes a sheet having a plurality of folding indicia preset therein for ease-of-folding into a prescription bag. Adhesive strips are located along the sheet to ease formation of the bag after completion of the necessary folds using the folding indicia. The formed prescription bag includes an upper opening through which the prescription items may be inserted into the bag and a sealed lower end. A label or printed information may be included on the outer surface of the bag to provide instructions or other relevant information regarding the prescription.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
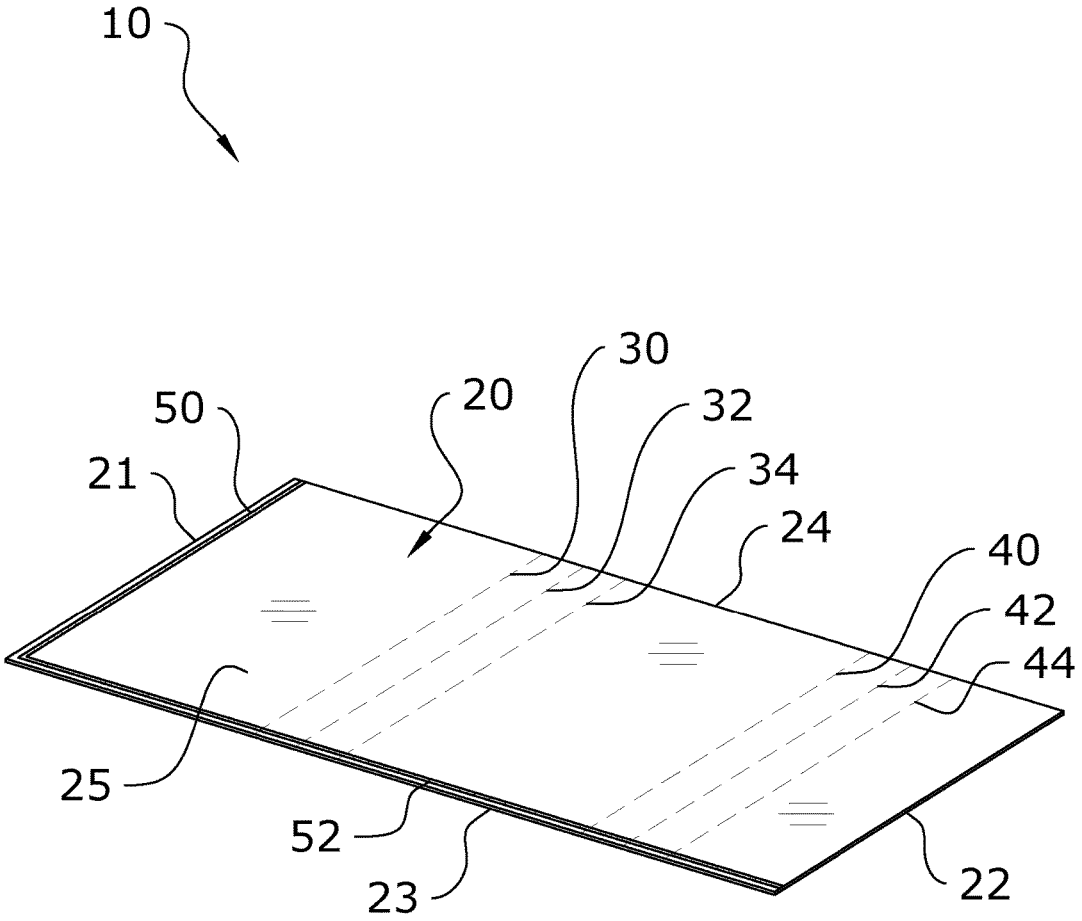
FIG. 1 is an upper perspective view of an unfolded sheet of the present invention.

A. Overview.

Turning now descriptively to the drawings, in which similar reference characters denote similar elements throughout the several views, FIGS. 1 through 10 illustrate a method of fabricating a prescription label bag 10, which comprises a sheet 20 having a plurality of folding indicia 30, 32, 34, 40, 42, 44 preset therein for ease-of-folding into a prescription bag 70. Adhesive strips 50, 52, 60, 62 are located along the sheet 20 to ease formation of the bag 70 after completion of the necessary folds using the folding indicia 30, 32, 34, 40, 42, 44. The formed prescription bag 70 includes an upper opening 78 through which the prescription items may be inserted into the bag 70 and a sealed lower end 74. A label 80 or printed information may be included on the outer surface of the bag 70 to provide instructions or other relevant information regarding the prescription.

B. Sheet.

Figure 10:
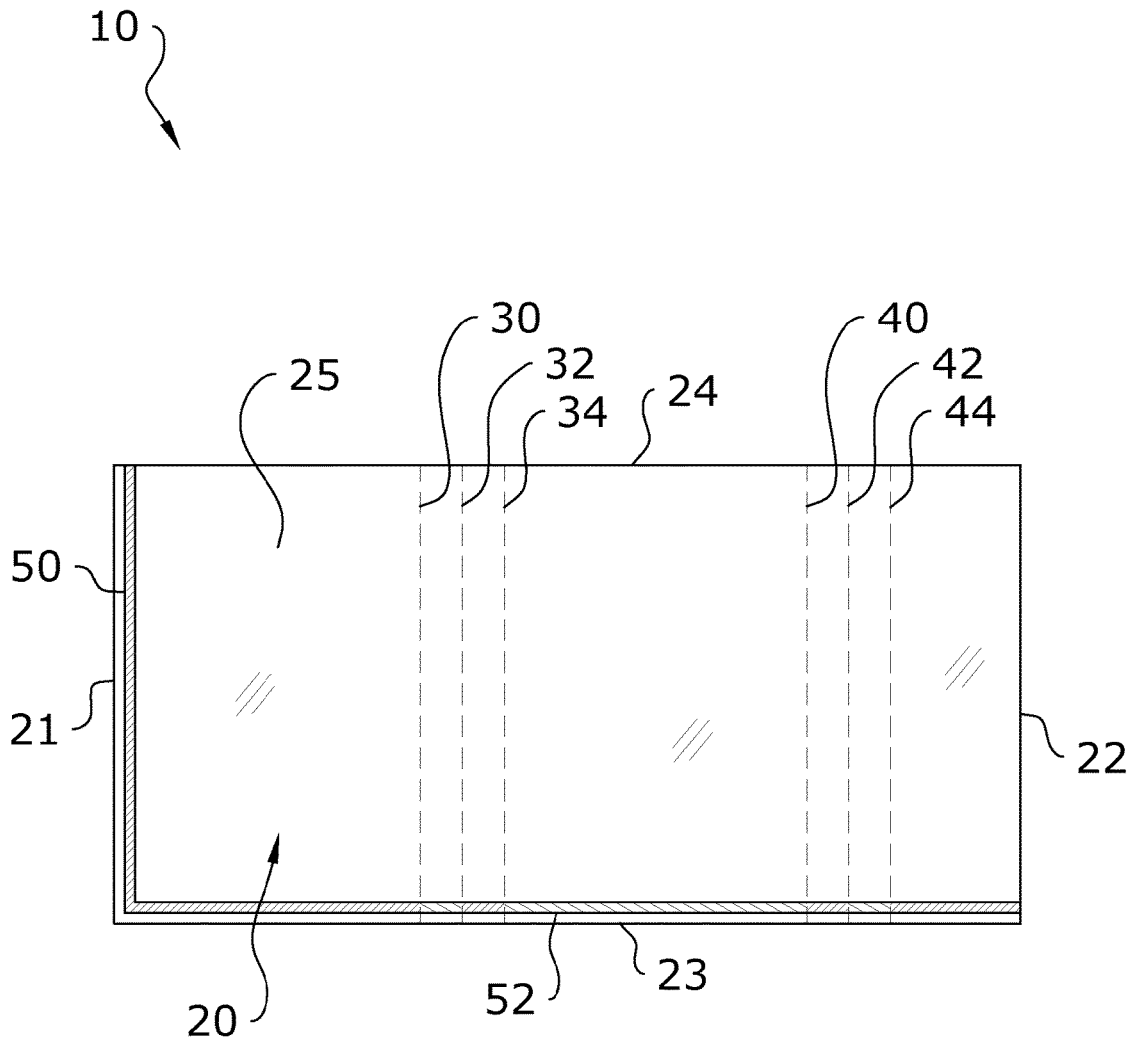
FIG. 10 is a top view of an unfolded sheet of the present invention.

As shown throughout the figures, the present invention includes a sheet 20 which is cut and pre-folded to aid with fabrication of the prescription bag 70. The sheet 20 is preferably rectangular as best shown in FIGS. 1 and 10, though some alternate embodiments of the present invention may utilize different shapes. The dimensions of the sheet 20 may also vary depending on the embodiment of the present invention, and the exemplary figures should not be construed as limiting on the scope of the present invention.

As best shown in FIGS. 1 and 10, the sheet 20 includes a first side 21, a second side 22, a first end 23, a second end 24, an upper surface 25, and a lower surface 26. The distance between the first and second sides 21, 22 will preferably be larger than the distance between the first and second ends 23, 24 to form the preferred rectangular shape of the sheet 20. In a preferred embodiment, the distance between the first and second sides 21, 22 will be at least twice the distance between the first and second ends 23, 24 as shown throughout the figures.

The sheet 20 will preferably include a plurality of folding indicia 30, 32, 34, 40, 42, 44 preset so as to aid with easy fabrication of the prescription bag 70 from the sheet 20. The use of preset folding indicia 30, 32, 34, 40, 42, 44 allows the sheets 20 to be sent to pharmacies pre-folding and allows employees to easily fold and prepare the prescription bag 70 on the fly. Shipping in sheets 20 reduces postage and allows for more of the present invention to be included in smaller shipment packages.

The figures illustrate a preferred arrangement of folding indicia 30, 32, 34, 40, 42, 44 for use with the present invention. The first, second, and third folding indicia 30, 32, 34 are generally grouped together at approximately a third of the distance between the first and second sides 21, 22 of the sheet 20 as shown in FIGS. 1 and 10. The fourth, fifth, and sixth folding indicia 40, 42, 44 are generally grouped together at approximately ¾ of the distance between the first and second sides 21, 22 of the sheet 20, adjacent to the second side 22.

The folding indicia 30, 32, 34, 40, 42, 44 are generally perforations which extend between the first and second ends 23, 24 of the sheet 20. In some embodiments, the folding indicia 30, 32, 34, 40, 42, 44 may instead by comprised of indicia such as creases, printed lines, stickers, or markings which indicate the proper folds to be taken with the sheet 20 to fabricate the prescription bag 70.

In a preferred embodiment as shown in FIGS. 1 and 10, a first folding indicia 30 extends between the first and second ends 23, 24 of the sheet 20 approximately a third of the distance between the first and second sides 21, 22 of the sheet 20. A second folding indicia 32 extends between the first and second ends 23, 24 of the sheet 20 a short distance from the first folding indicia 30. The second folding indicia 32 extends parallel to the first folding indicia 30 and is positioned between the first folding indicia 30 and the second side 22 of the sheet 20. A third folding indicia 34 extends between the first and second ends 23, 24 of the sheet 20 a short distance from the second folding indicia 32. The third folding indicia 34 extends parallel to the first and second folding indicia 30, 32 and is positioned between the second folding indicia 32 and the second side 22 of the sheet 20.

In a preferred embodiment as shown in FIGS. 1 and 10, a fourth folding indicia 40 extends between the first and second ends 23, 24 of the sheet 20 approximately ¾ of the distance between the first and second ends 23, 24 of the sheet 20. A fifth folding indicia 42 extends between the first and second ends 23, 24 of the sheet 20 a short distance from the fourth folding indicia 40. The fifth folding indicia 42 extends parallel to the fourth folding indicia 40 and is positioned between the fourth folding indicia 40 and the second side 22 of the sheet 20. A sixth folding indicia 44 extends between the first and second ends 23, 24 of the sheet 20 a short distance from the fifth folding indicia 42. The sixth folding indicia 44 extends parallel to the third and fourth folding indicia 40, 42 and is positioned between the fifth folding indicia 42 and the second side 22 of the sheet 20.

The sheet 20 also includes adhesives 50, 52, 60, 62 to aid with fabrication of the prescription bag 70. It should be appreciated that a wide range of adhesives 50, 52, 60, 62 may be utilized, including cohesive substances, adhesive substances, tape, or any other composition, substance, or structure adapted to quickly and securely secure different portions of the sheet 20 together as described herein.

As best shown in FIGS. 1 and 10, a first upper adhesive 50 extends on the upper surface 25 of the sheet 20 between the first and second ends 23, 24 adjacent to its first side 21, parallel to the folding indicia 30, 32, 34, 40, 42, 44. A second upper adhesive 52 extends on the upper surface 24 of the sheet 20 between the first and second sides 21, 22 adjacent to its first end 23. The upper adhesives 50, 52 may be comprised of various configurations, but are preferably comprised of adhesive strips 50, 52 as shown in the figures.

Figure 2:
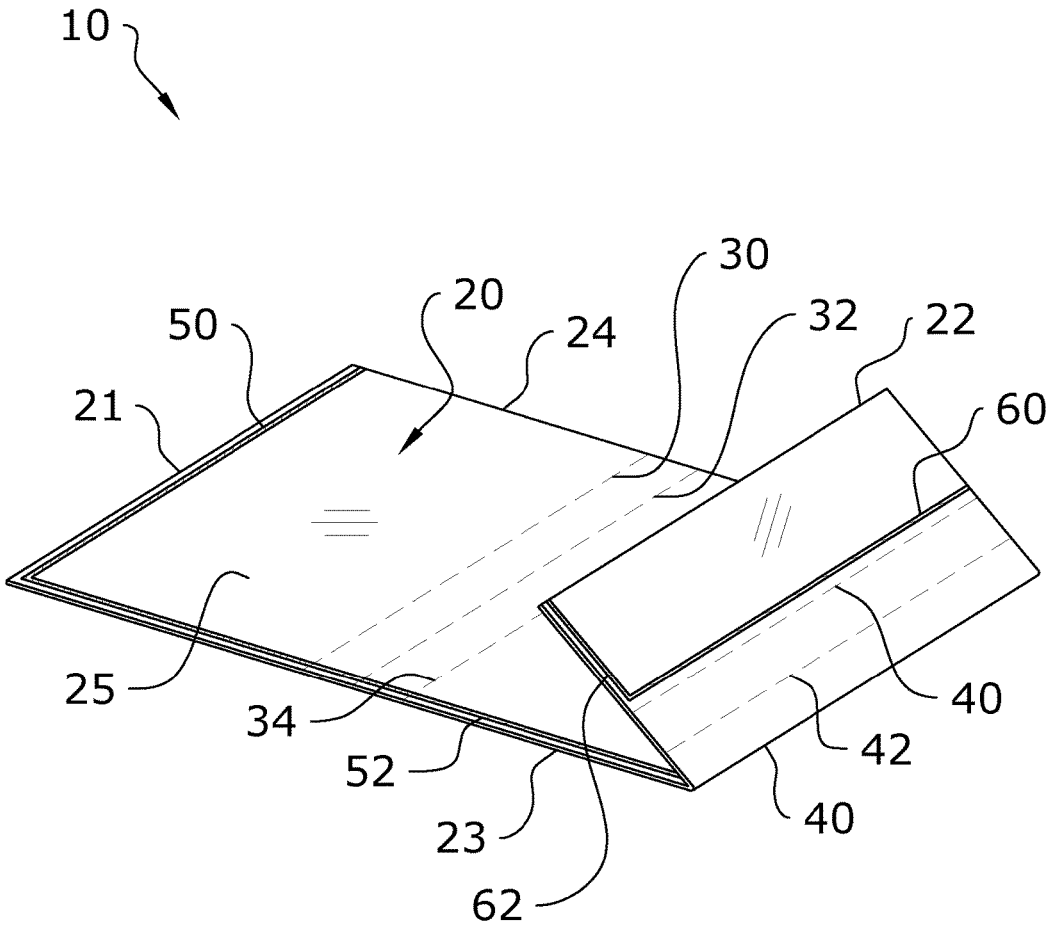
FIG. 2 is an upper perspective view of the first fold of the present invention.

As best shown in FIG. 2, a first lower adhesive 60 extends on the lower surface 26 of the sheet 20 between its first and second ends 23, 24 directly adjacent to the sixth folding indicia 44, at a position between the sixth folding indicia 44 and the first side 21 of the sheet 20. A second lower adhesive 62 extends on the lower surface 26 of the sheet 20 between its second side 22 and the sixth folding indicia 44. The second lower adhesive 62 extends perpendicular with respect to the folding indicia 30, 32, 34, 40, 42, 44. The lower adhesives 60, 62 may be comprised of various configurations, but are preferably comprised of adhesive strips 60, 62 as shown in the figures.

C. Method of Fabrication.

FIGS. 2-8 illustrate fabrication of the prescription bag 70 from the sheet 20. What follows is a preferred method of fabrication, and it should be appreciated that slight variations in the order of folds may be practiced without affecting the overall operation of the present invention.

FIG. 2 illustrates the first fold necessary for fabricating the prescription bag 70. First, the sheet 20 is folded in a first direction toward the first side 21 of the sheet 20 along the fourth folding indicia 40. The sheet 20 need not be completely folded over, but instead may be partially folded as shown in FIG. 2.

Figure 3:
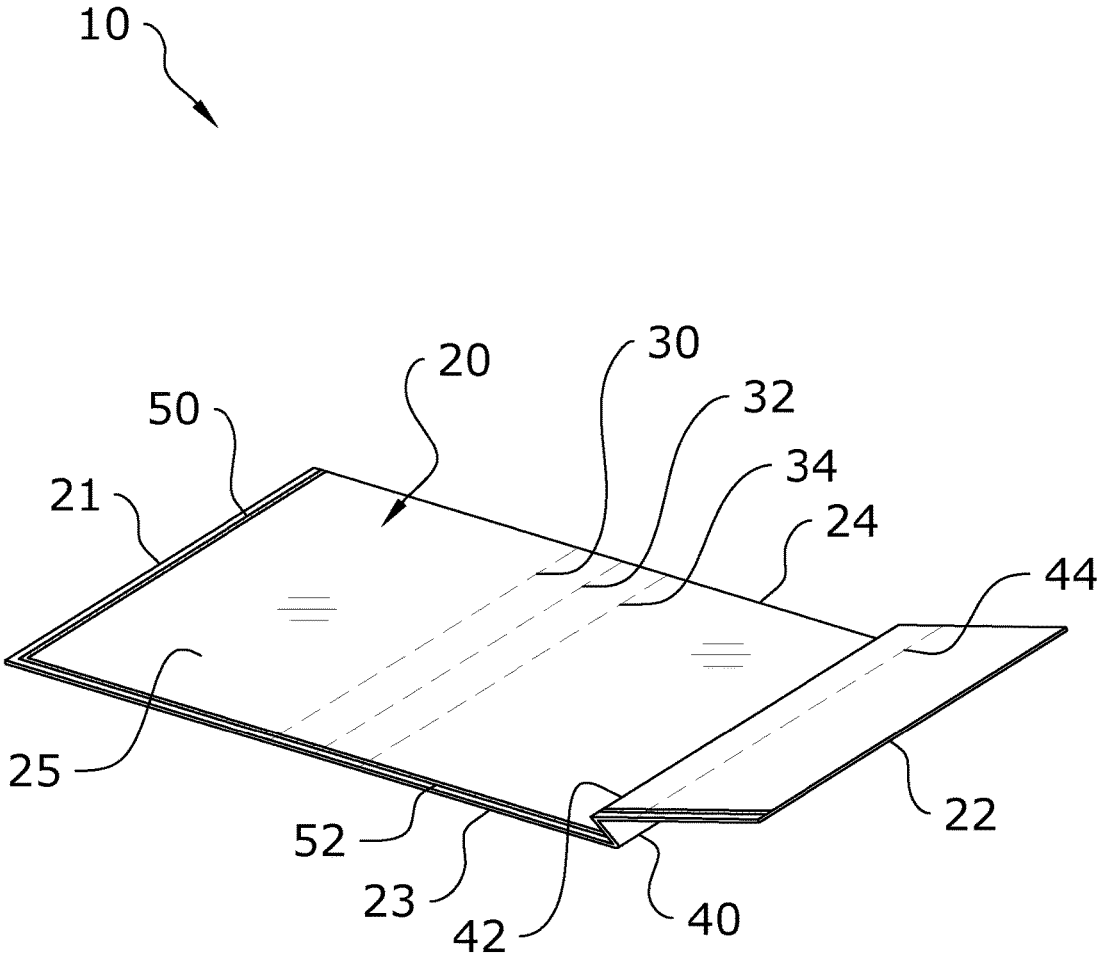
FIG. 3 is an upper perspective view of the second fold of the present invention.

FIG. 3 illustrates the second fold, wherein the sheet 20 is folded back in a second direction toward the second side 22 of the sheet 20 along the fifth folding indicia 42 (i.e. in the opposite direction from the first fold). This will begin to form the second side crease 76 of the completed prescription bag 70.

Figure 4:
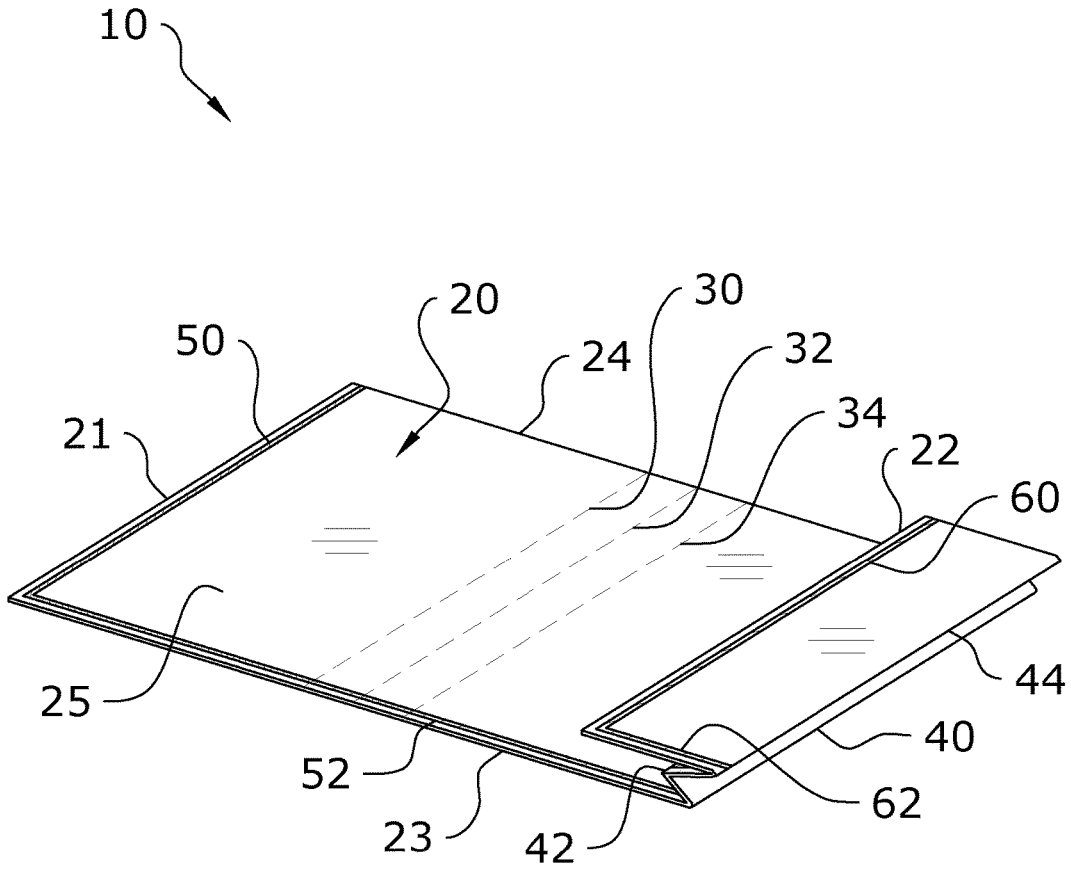
FIG. 4 is an upper perspective view of the third fold of the present invention.

FIG. 4 illustrates the third fold, which completes formation of the second side crease 76. The sheet 20 is folded in the first direction toward the first side 21 of the sheet 20 along the sixth folding indicia 44, and the first folded portion of the sheet 20 between the sixth folding indicia 44 and the second side 22 is retained in a position parallel to the unfolded sheet 20 as shown in FIG. 4.

Figure 5:
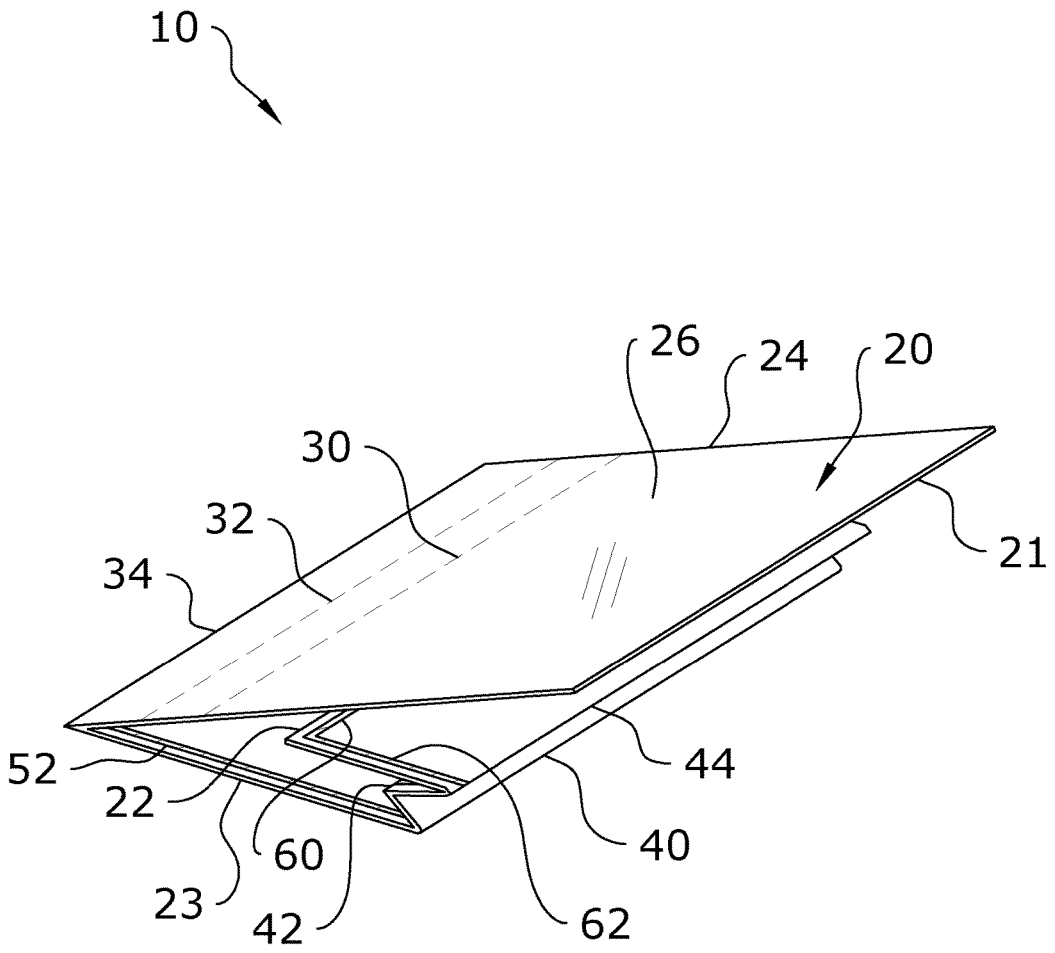
FIG. 5 is an upper perspective view of the fourth fold of the present invention.

A similar process is then followed to form the first side crease 74. As shown in FIG. 5, the sheet 20 is folded in the second direction toward the second side 22 of the sheet 20 along the first folding indicia 30. The sheet 20 is not completely folded over, but instead is partially folded as shown in FIG. 5.

Figure 6:
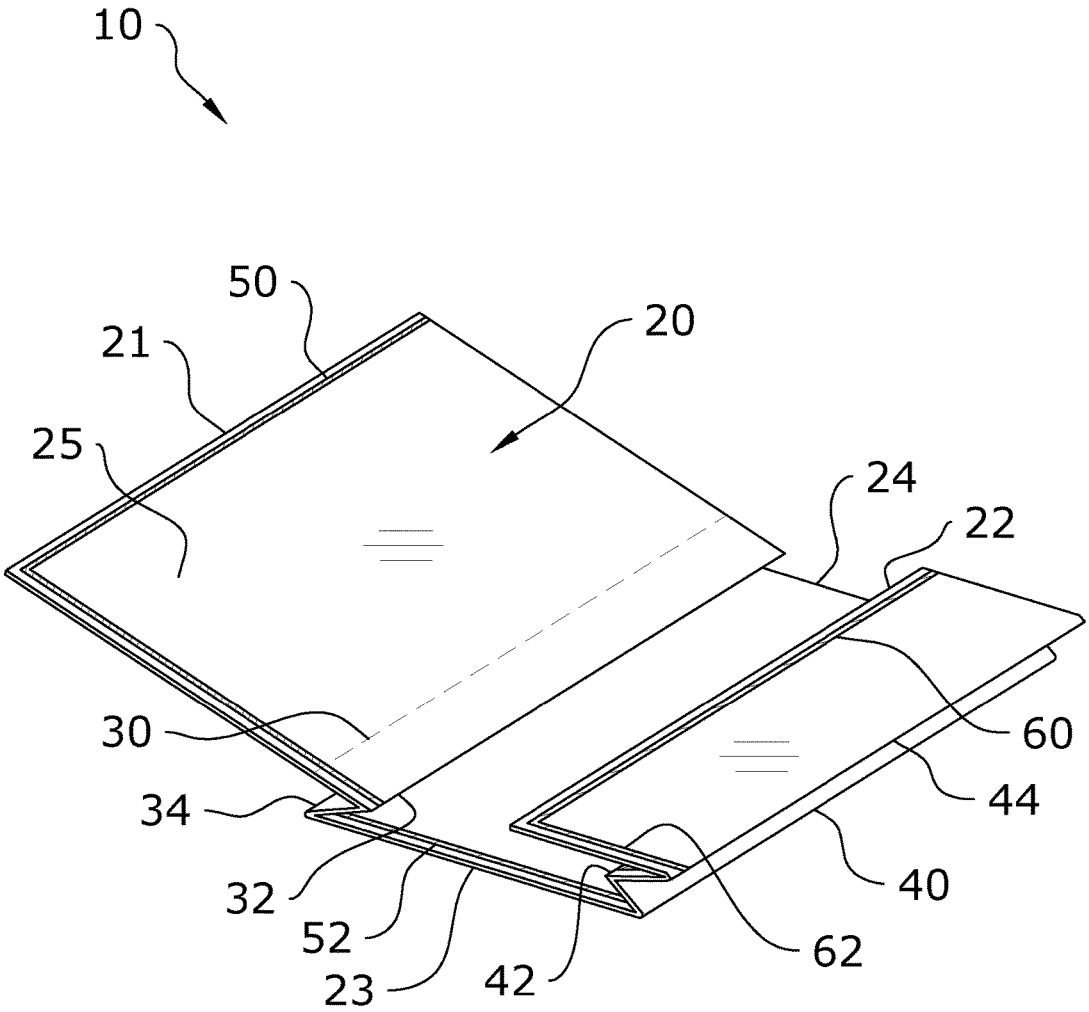
FIG. 6 is an upper perspective view of the fifth fold of the present invention.

FIG. 6 illustrates the next fold, wherein the sheet is folded in the first direction toward the first side 21 of the sheet 20 along the second folding indicia 32 to begin formation of the first side crease 75 of the completed prescription bag 70. The final fold is shown in FIG. 7, wherein the sheet 20 is folded in the second direction toward the second side 22 of the sheet 20 along the third folding indicia 34.

Figure 7:
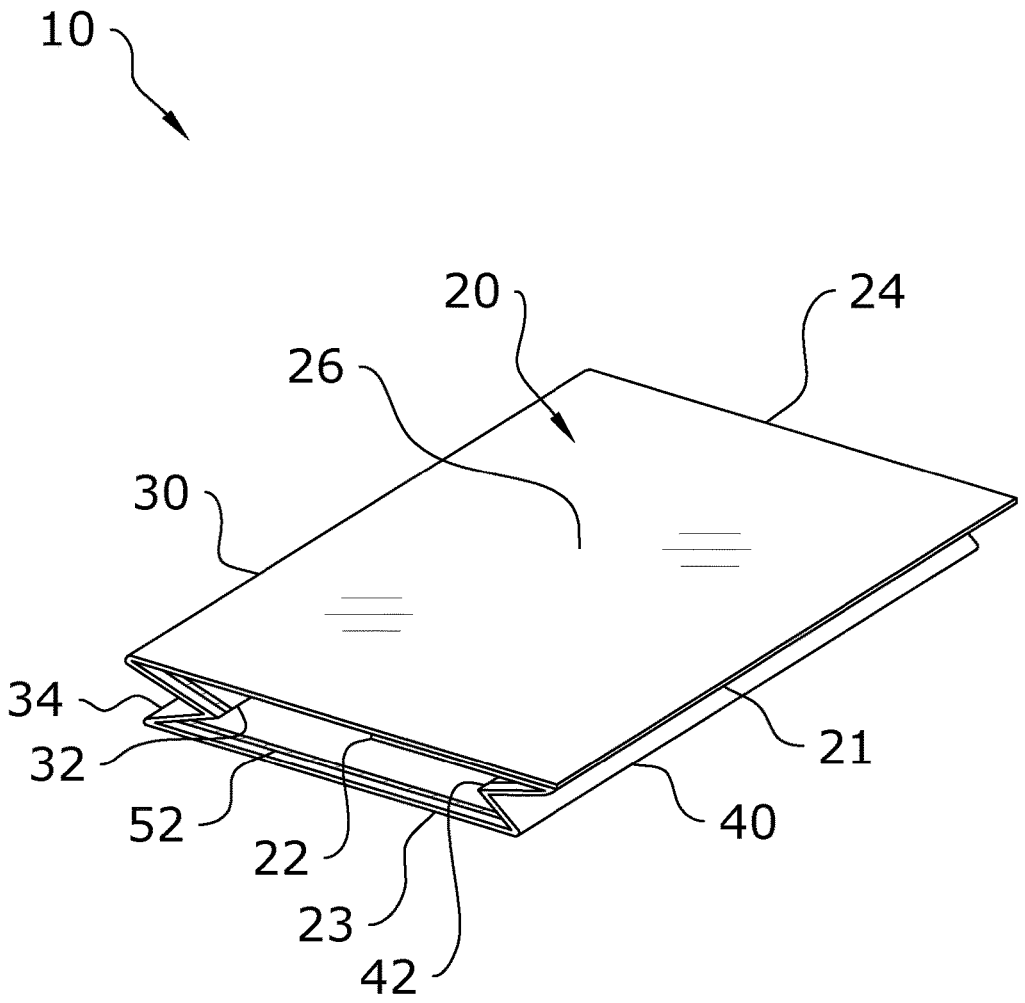
FIG. 7 is an upper perspective view of the sixth and final fold of the present invention.

The second folded portion of the sheet 20 between the first folding indicia 30 and the first side 21 is retained in a position parallel to the unfolded sheet 20 and rested on top of the first folded portion as shown in FIG. 7. The first upper adhesive strip 50 will adhesively secure with the first lower adhesive strip 60. A portion of the second upper adhesive strip 52 will adhesively secure with the second lower adhesive strip 62 to begin formation of the prescription bag 70.

Figure 8:
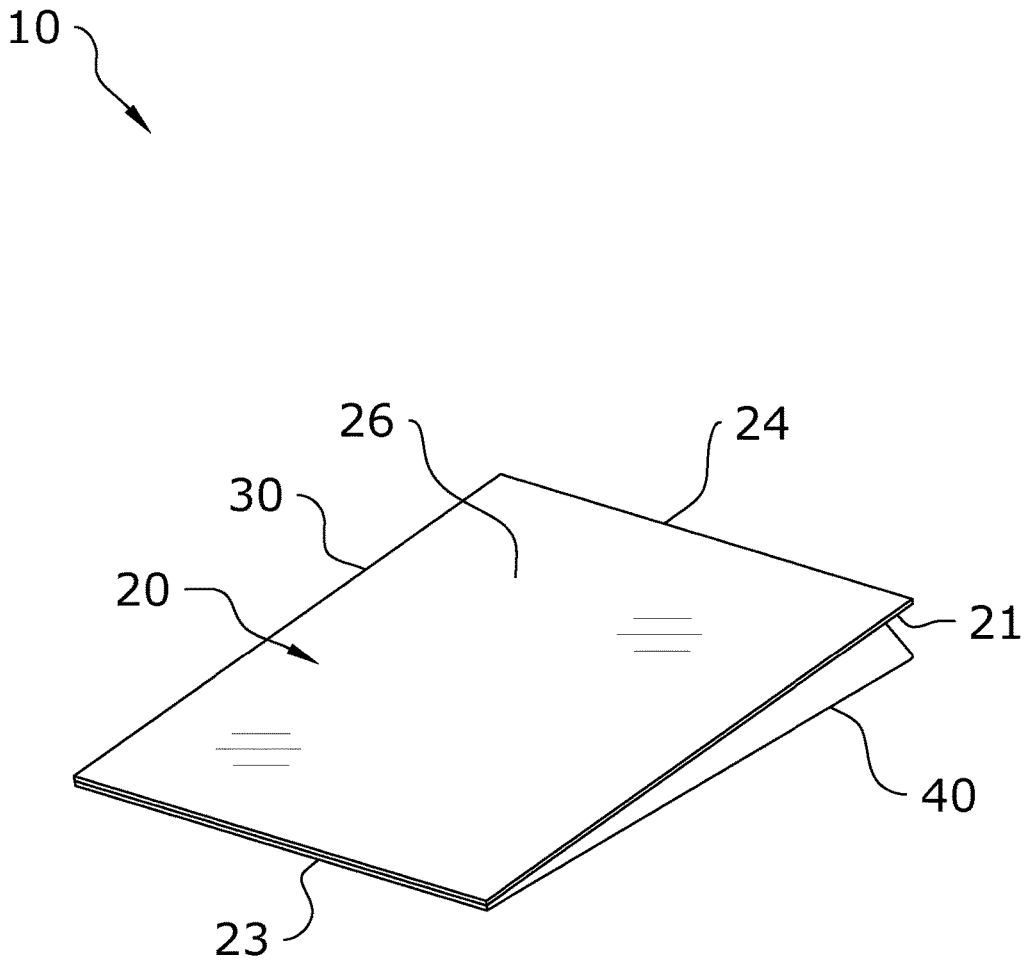
FIG. 8 is an upper perspective view of the closure of the lower end of the prescription bag.

The prescription bag 70 begins to take form with an opening extending fully therethrough as shown in FIG. 7. In FIG. 8, it is shown how the lower end 74 of the prescription bag 70 is sealed. The first end 23 of the sheet 20 is pressed together, which adhesively secures the first upper adhesive 50 against itself to seal the lower end 74 of the bag 70 as shown in FIG. 8.

D. Prescription Bag.

Figure 9:
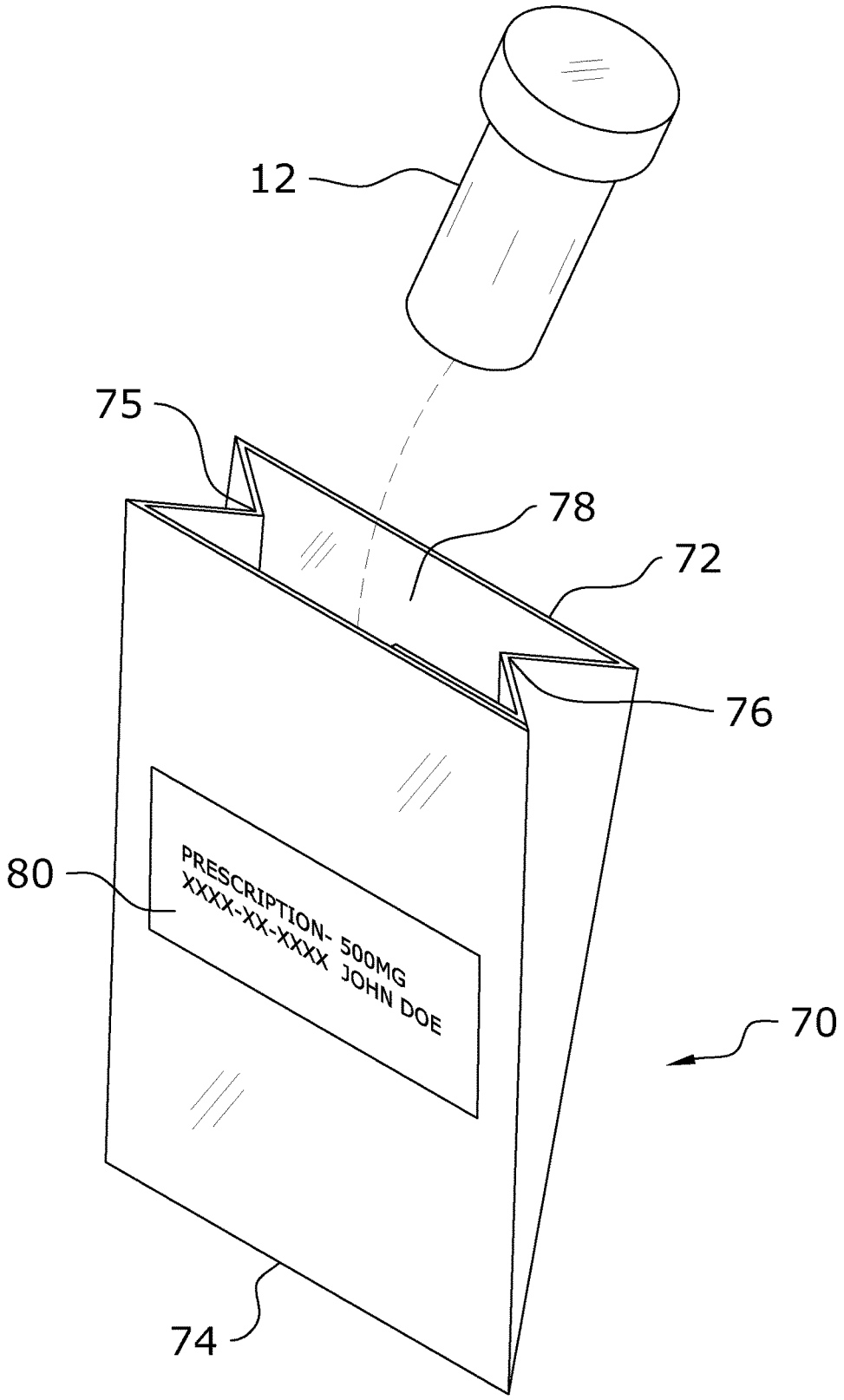
FIG. 9 is an upper perspective view of a pill bottle being inserted into the prescription bag.

The completed prescription bag 70 is shown in FIG. 9. The bag 70 includes an upper end 72 having an upper opening 78 and a sealed lower end 74. A first side crease 75 and second side crease 76 allow the bag 70 to be flared out for storage of wider items. A pill bottle 12 may then be positioned within the bag 70. A label 80 or printed information may be provided on the outer surface of the bag 70 to provide instructions for use or any other relevant information related to the prescription drug being stored therein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A sheet for formation of a prescription bag, comprising:

a sheet having a first end, a second end, a first side, and a second side;

a first folding indicia extending between said first end and said second end of said sheet at a position approximately ⅓ of the distance between said first side and said second side;

a second folding indicia positioned adjacent to said first folding indicia, wherein said second folding indicia extends parallel to said first folding indicia, wherein said second folding indicia is positioned between said first folding indicia and said second side of said sheet;

a third folding indicia positioned adjacent to said second folding indicia, wherein said third folding indicia extends parallel to said second folding indicia, wherein said third folding indicia is positioned between said second folding indicia and said second side of said sheet;

a fourth folding indicia extending between said first end and said second end of said sheet at a position approximately ¾ of the distance between said first side and said second side;

a fifth folding indicia positioned adjacent to said fourth folding indicia, wherein said fifth folding indicia extends parallel to said fourth folding indicia, wherein said fifth folding indicia is positioned between said fourth folding indicia and said second side of said sheet;

a sixth folding indicia positioned adjacent to said fifth folding indicia, wherein said sixth folding indicia extends parallel to said fifth folding indicia, wherein said sixth folding indicia is positioned between said fifth folding indicia and said second side of said sheet;

a first upper adhesive on an upper surface of said sheet between said first end and said second end adjacent to said first side of said sheet;

a second upper adhesive on said upper surface of said sheet between said first side and said second side adjacent to said first end, wherein the first upper adhesive is oriented perpendicularly with respect to the second upper adhesive;

a first lower adhesive on a lower surface of said sheet between said first end and said second end adjacent to said sixth folding indicia;

a second lower adhesive on said lower surface of said sheet between said second side and said sixth folding indicia, wherein the first lower adhesive is oriented perpendicularly with respect to the second lower adhesive; and a label removably connected to the sheet, wherein the label includes printed information relating to an object to be stored in the prescription bag.

2. The sheet for formation of a prescription bag of claim 1, wherein said first folding indicia, said second folding indicia, said third folding indicia, said fourth folding indicia, said fifth folding indicia and said sixth folding indicia are each comprised of a line of perforations in said sheet.

3. The sheet for formation of a prescription bag of claim 1, wherein said first folding indicia, said second folding indicia, said third folding indicia, said fourth folding indicia, said fifth folding indicia and said sixth folding indicia are each comprised of a crease formed in said sheet.

4. The sheet for formation of a prescription bag of claim 1, wherein said second lower adhesive extends perpendicular with respect to said first folding indicia.

5. The sheet for formation of a prescription bag of claim 4, wherein said first upper adhesive is comprised of a first adhesive strip and wherein said second upper adhesive is comprised of a second adhesive strip.

6. The sheet for formation of a prescription bag of claim 5, wherein said first lower adhesive is comprised of a third adhesive strip and wherein said second lower adhesive is comprised of a fourth adhesive strip.

* * * * *